US012782044B2

(12) United States Patent
Valär

(10) Patent No.: US 12,782,044 B2
(45) Date of Patent: Nov. 3, 2026

(54) METHOD AND APPARATUS FOR RELIQUEFICATION AND RECYCLING OF BOIL-OFF GAS INTO AN LNG TANK

(71) Applicant: BURCKHARDT COMPRESSION AG, Winterthur (CH)

(72) Inventor: Adrian Luzi Valär, Winterthur (CH)

(73) Assignee: BURCKHARDT COMPRESSION AG, Winterthur (CH)

( * ) Notice: Subject to any disclaimer, the term of this patent is extended or adjusted under 35 U.S.C. 154(b) by 174 days.

(21) Appl. No.: 18/837,736

(22) PCT Filed: Feb. 10, 2023

(86) PCT No.: PCT/EP2023/053266
§ 371 (c)(1),
(2) Date: Aug. 12, 2024

(87) PCT Pub. No.: WO2023/152267
PCT Pub. Date: Aug. 17, 2023

(65) Prior Publication Data

US 2025/0314423 A1 Oct. 9, 2025

(30) Foreign Application Priority Data

Feb. 10, 2022 (EP) ..... 22156041

(51) Int. Cl.
*F25J 1/00* (2006.01)
*F25J 1/02* (2006.01)

(52) U.S. Cl.
CPC ..... *F25J 1/0025* (2013.01); *F25J 1/0244* (2013.01); *F25J 1/0277* (2013.01); *F25J 1/0279* (2013.01); *F25J 2240/40* (2013.01)

(58) Field of Classification Search
None
See application file for complete search history.

(56) References Cited

U.S. PATENT DOCUMENTS 10,518,859 B2 * 12/2019 Lee ..... B63H 21/38
10,767,573 B2 * 9/2020 Högnabba ..... F02M 21/0236
(Continued)

FOREIGN PATENT DOCUMENTS

CN 204477687 U * 7/2015
EP 2629035 A1 8/2013
(Continued)

OTHER PUBLICATIONS

Man Diesel & Turbo., ME-GI Dual Fuel Man B&W Engines, A Technical, Operational and Cost-effective Solution for Ships Fuelled by Gas, 36 pages, XP055505574, Apr. 1, 2012.
(Continued)

*Primary Examiner* — Jenna M Maroney
(74) *Attorney, Agent, or Firm* — Brooks Kushman P.C.

(57) ABSTRACT

A method for reliquefying and returning boil-off gas (BOG) to a liquefied natural gas (LNG) tank, having the steps of: compressing a BOG taken from the headspace of an LNG tank to a pressure $p_{high}$, cooling the compressed gas to a temperature $T_1$, such as by water cooling; expanding at least part of the gas from step c) to a pressure $p_{expand}$; cooling the gas expanded in step d), such as by a heat exchanger in counterflow with cooling BOG (F2) from the head space of the LNG tank 3 to a temperature $T_4$; returning the gas from step e) to the LNG tank; wherein the pressure $p_{high}$ is at least 200 bar, and wherein the pressure $p_{expand}$ is 80 to 180 bar.

14 Claims, 2 Drawing Sheets

(56) References Cited

U.S. PATENT DOCUMENTS

Figure 1:
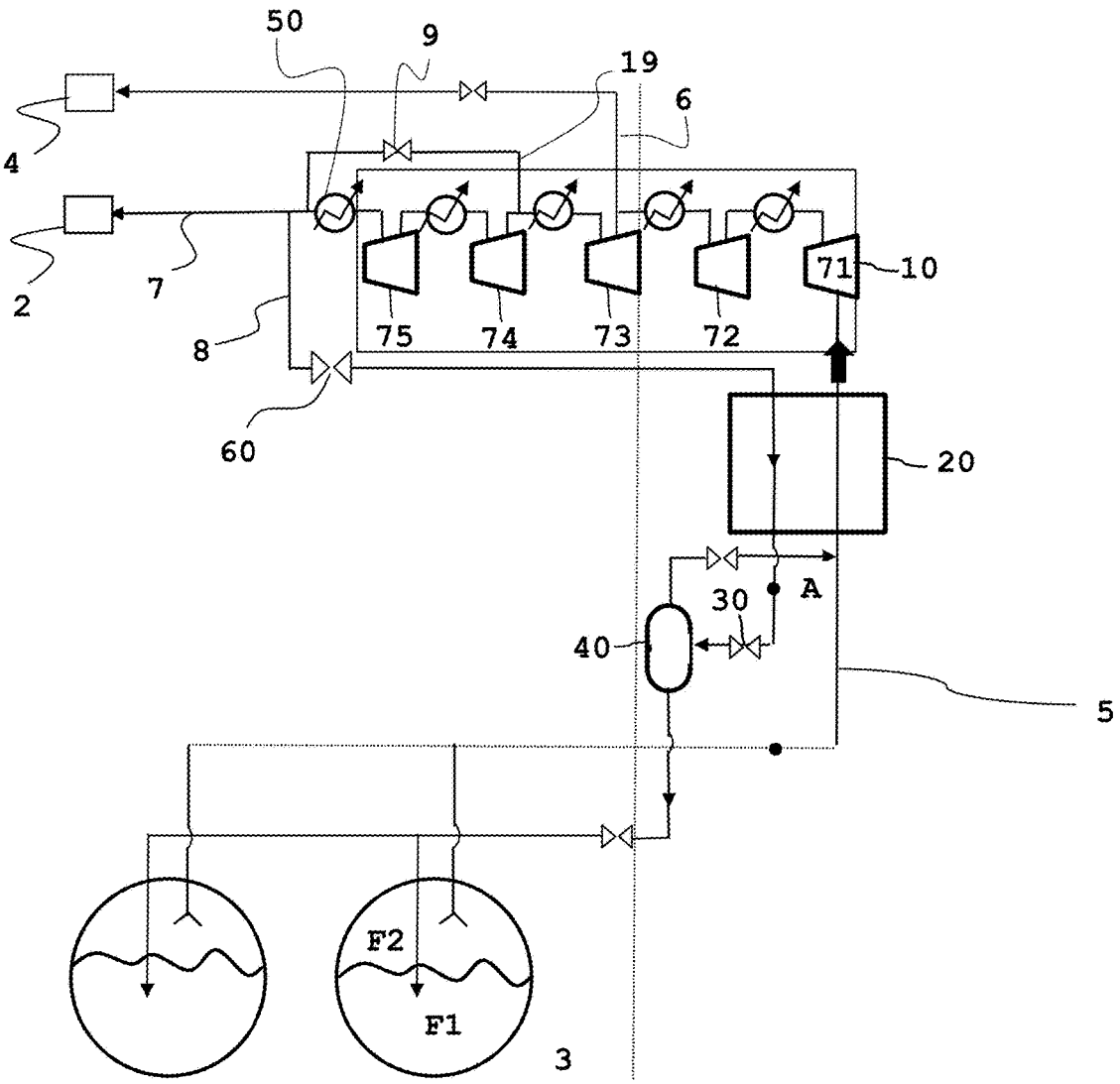

| | | | | |
|---|---|---|---|---|
| 11,473,730 | B2 * | 10/2022 | Lee | F25J 1/004 |
| 11,698,169 | B2 * | 7/2023 | Hodgson | F17C 13/002 62/48.1 |
| 11,724,781 | B2 * | 8/2023 | Lee | F25J 1/004 62/611 |
| 12,044,363 | B2 * | 7/2024 | Lee | F17C 9/04 |
| 12,117,131 | B2 * | 10/2024 | Lee | F17C 9/04 |
| 2011/0103976 | A1 * | 5/2011 | Fejzuli | F04B 25/00 417/285 |
| 2011/0185748 | A1 * | 8/2011 | Fuchs | F17C 9/04 62/53.2 |
| 2014/0290279 | A1 * | 10/2014 | Lee | F25J 1/0277 123/3 |
| 2015/0285189 | A1 * | 10/2015 | Lee | F02M 21/0221 62/48.1 |
| 2016/0114876 | A1 * | 4/2016 | Lee | F17C 7/04 62/48.1 |
| 2017/0167785 | A1 * | 6/2017 | Pierre, Jr. | F25J 1/0234 |
| 2019/0351988 | A1 * | 11/2019 | Jung | F25J 1/0025 |
| 2020/0208780 | A1 | 7/2020 | Jang | |

FOREIGN PATENT DOCUMENTS

| | | | | |
|---|---|---|---|---|
| KR | 20100139013 | A * | 12/2010 | F04B 25/00 |
| KR | 20140075581 | A | 6/2014 | |
| KR | 20160091091 | A * | 8/2016 | F25J 1/0025 |
| KR | 20160103324 | A | 9/2016 | |
| KR | 20160142257 | A * | 12/2016 | F17C 9/02 |
| KR | 102186043 | B1 * | 12/2020 | F25J 1/0277 |
| WO | WO-2014065621 | A1 * | 5/2014 | B63H 21/38 |
| WO | WO-2014092369 | A1 * | 6/2014 | B63H 21/38 |
| WO | WO-2018160182 | A1 * | 9/2018 | F25J 1/0087 |
| WO | WO-2018230950 | A1 * | 12/2018 | B63H 21/38 |

OTHER PUBLICATIONS

International Search report for PCT/EP2023/053266, prepared by the European Patent Office, mailing date Apr. 4, 2023, 7 pages.

* cited by examiner

METHOD AND APPARATUS FOR RELIQUEFICATION AND RECYCLING OF BOIL-OFF GAS INTO AN LNG TANK

CROSS-REFERENCE TO RELATED APPLICATION

This application is the U.S. national phase of PCT Application No. PCT/EP2023/053266 filed on Feb. 10, 2023, which claims priority to EP patent application Ser. No. 22/156,041.0 filed on Feb. 10, 2022.

The invention relates to the technical field of reliquefying exhaust gas (BOG) from a liquefied natural gas (LNG) tank.

Recently, the consumption of liquefied gas such as liquefied natural gas (LNG) has risen sharply worldwide. LNG, which is obtained by cooling natural gas to an extremely low temperature, has a small volume and is therefore well suited for storage and transportation. In addition, liquefied natural gas, like LNG, is low in pollutants and therefore more compatible with regulations than heavy fuel oil, for example.

LNG is a colorless and transparent liquid that is obtained by cooling natural gas, which consists mainly of methane, to around −163° C. However, since natural gas is liquefied at an extremely low temperature of −163° C. under normal pressure, LNG can easily vaporize if the temperature rises slightly. In an LNG storage tank, LNG is therefore continuously vaporized naturally to produce boil-off gas (BOG).

The formation of BOG means a loss of stored LNG and therefore reduces transport efficiency on an LNG tanker, for example. If BOG accumulates in a storage tank, there is also a risk that the pressure in the storage tank will rise and the tank will be damaged.

To address the problem, a method in which BOG is re-liquefied to return it to an LNG storage tank, a method in which BOG is supplied as an energy source to an internal combustion engine, such as a marine engine, and combinations thereof have been proposed.

In US2019/0351988, for example, it is proposed to supply BOG from an LNG tank to a DFDE engine, an X-DF engine or an ME-GI marine engine. At the same time, it is provided to use BOG as a refrigerant to reliquefy compressed BOG in a partial reliquefaction system (PRS). However, this system has the disadvantage that only a limited amount of BOG is available as a refrigerant and therefore only insufficiently low temperatures are reached when there is a high demand for reliquefaction. This means that only a small proportion of the BOG can be effectively reliquefied. A considerable proportion of the compressed and cooled gas is fed back into the reliquefaction cycle in gaseous form and the system proves to be less efficient.

It is therefore the problem of the present invention to provide a method for the partial reliquefaction of BOG or a partial reliquefaction system (PRS) in which BOG is used directly as a coolant and in which a high level of efficiency is nevertheless achieved.

The problem is solved by a method having the features of claim 1 and a device having the features of claim 5.

In particular, the problem is solved by a method for reliquefying and returning boil-off gas (BOG) to a liquefied natural gas (LNG) tank, comprising the steps:

a) Removal of BOG (F2) from the headspace of an LNG tank;

b) Compressing the BOG to a pressure $p_{high}$;

c) Cooling the compressed gas to a temperature $T_1$, preferably by water cooling;

d) expanding at least part of the gas from step c) to a pressure $p_{expand}$;

e) Cooling the gas expanded in step d), preferably by means of a heat exchanger in counterflow with cooling BOG (F2) from the head space of the LNG tank, to a temperature $T_4$;

f) Returning the gas from step e) to the LNG tank;

wherein the pressure $p_{high}$ is at least 200 bar, preferably at least 250 bar, particularly preferably at least 300 bar, and wherein the pressure $p_{expand}$ is 80 to 180 bar, preferably 120 to 160 bar, particularly preferably 150 bar.

This process is based on the idea that the cooling liquid used to reliquefy the BOG in step e) is only available to a limited extent and/or should be used sparingly. In the case of a separate cooling circuit with a corresponding refrigerant, typically $N_2$, cooling costs energy. If BOG from the LNG tank is used as a coolant instead, a low flow rate is desirable from a storage/transportation efficiency point of view, especially if an engine does not have to be operated with the natural gas fuel at the same time or if the engine (temporarily) only has a low fuel requirement. In contrast, however, the coolant for cooling the compressed gas to ambient temperature, in particular water, is available in practically unlimited quantities.

The inventors have recognized that it can therefore be useful to provide a gas for cooling step e) that has a low heat content. This can be achieved by compressing the gas to a comparatively high pressure $p_{high}$ and cooling it at this high pressure by water cooling. If the gas is then at least partially iso-enthalpically expanded in step d) before it is fed to the cooling in step e), a higher proportion of gas can be reliquefied with the available cooling capacity than if it were reliquefied without step d) or starting from a lower pressure (e.g. 150 bar).

Preferred is a method for supplying a high-pressure gas injection engine with gas partially stored in an LNG tank as exhaust vapor gas (BOG, F2) and for reliquefying and recycling BOG, comprising the steps according to claim 1, wherein in step d) at least a first portion of the gas from step c) is supplied to the high-pressure gas injection engine via an outlet to the extent of the fuel requirement of a high-pressure gas injection engine, and at least a second portion of the gas from step c) is expanded to the pressure $p_{expand}$.

In this embodiment, the highly compressed gas at pressure $p_{high}$ can either be used to drive a high-pressure gas injection engine or be reliquefied. Natural gas is the fuel of choice, particularly on a liquefied gas tanker, in order to keep the emission of air pollutants to a relatively low level. The adjustability of the quantity fed to the gas injection engine or into the PRS makes it possible to respond flexibly to climatic and meteorological conditions as well as the fuel requirements of the high-pressure gas injection engine.

It is further preferred that in the method as described above, step b) is preceded by a step 0) and step 0) is the selection between an operating mode i) compressing the BOG to a pressure $p_{high}$ comprising steps b) to d); and an operating mode ii) compressing the BOG to a pressure $p_{low}$, comprising the steps of b1) compressing the BOG to a pressure $p_{low}$ of 100 to 199 bar, preferably 140 to 160 bar; and d1) expansion of at least part of the gas from step c) to a pressure $p_{expand}$, provided that $p_{low}>p_{expand}$;

wherein, in the case of operating mode ii), steps b1) and d1) replace steps b) and d).

In such a method, it is possible to adjust the operating mode. It has been found that at a low reliquefaction rate it can be efficient to compress only to a lower pressure $p_{low}$ (step b1), because the BOG provides sufficient cooling capacity to cool the gas stream to be liquefied to a sufficiently low temperature level. Compressing to a high pressure at a high liquefaction rate, on the other hand, proves to be more efficient because the additional cooling from the expansion of the gas to be liquefied from $p_{high}$ to $p_{low}$ contributes to a higher reliquefaction rate and therefore to a more efficient overall system.

A process in which a setpoint value $p_{high}$ in the range from 200 to 300 bar is selected in step 0) in operating mode i) and/or a setpoint value $p_{low}$ in the range from 100 to 199 bar is selected in operating mode ii) is particularly preferred. The resulting continuous adjustability between 100 and 300 bar makes it possible to obtain even more flexibility in the reliquefaction cycle.

One aspect of the invention relates to a device for reliquefying and returning boil-off gas (BOG) into a liquefied natural gas (LNG) tank, comprising

- a heat exchanger comprising a line for the passage of cooling fluid, preferably BOG from an LNG tank, and a line for the passage of compressed gas to be cooled;
- a multi-stage compressor arrangement that is set up to compress BOG (F2) from the LNG tank to a pressure $p_{high}$;
- a first cooler;
- a return line; and
- a first expansion unit, which is set up to expand compressed gas from a pressure $p_{high}$ to a pressure $p_{expand}$;

wherein the multi-stage compressor arrangement is fluidly connected upstream, optionally via the line of the heat exchanger for the passage of cooling fluid, to a discharge line opening into the head space of the LNG tank, and wherein the multi-stage compressor arrangement is fluidly connected downstream to the first cooler, further downstream via the return line to the first expansion unit, and still further downstream to the line of the heat exchanger for the passage of compressed gas to be cooled, in order to return the compressed and cooled gas to the LNG tank;

wherein the pressure $p_{high}$ is at least 200 bar, preferably at least 250 bar, particularly preferably 300 bar; and wherein the pressure $p_{expand}$ is 80 to 180 bar, preferably 120 to 160 bar, particularly preferably 150 bar.

This device solves the problem described above. A gas with low heat is provided for the cooling step in the indirect heat exchanger. This is achieved by compressing the gas to a comparatively high pressure $p_{high}$ and cooling it at this high pressure by water cooling. If the gas is then at least partially isenthalpically expanded in step d) before it is fed to the cooling in the heat exchanger, a higher proportion of gas can be reliquefied with the available cooling capacity than if it were cooled and reliquefied without the expansion preceding the cooling step, i.e. starting from a gas that is only compressed to a lower pressure (e.g. 150 bar).

An advantage associated with the device is the gain in efficiency with a high flow rate of BOG, as described above at process level. Another design advantage is that the pressure in the intermediate stage(s) before the last compression stage does not need to be controlled. If, for example, part of the gas were to be extracted through a branch line after an intermediate stage (e.g. at $p_{low}$) and fed to the PRS, the pressure after this intermediate stage would typically have to be regulated with a pressure control valve (PCV). If, on the other hand, the entire volume of BOG conveyed is uniformly compressed to the pressure $p_{high}$, a single PCV is sufficient, which reduces the cost of the device. Finally, thanks to the improved efficiency of the device, a smaller PRS is sufficient, and thanks to the lower gas flow, a smaller multi-stage compressor arrangement is also sufficient. Surprisingly, this is despite the fact that all compression stages must be designed to handle the entire BOG flow. Smaller devices save valuable space, especially if the device is to be used on a ship, e.g. a tanker. Less energy is also required for efficient reliquefaction.

In a preferred embodiment, the device is part of a fuel gas supply system for supplying a high-pressure gas injection engine with gas stored in an LNG tank, additionally comprising

- an outlet which is arranged downstream of the multi-stage compressor arrangement in a fluid-conducting manner and opens further downstream into a supply line for a high-pressure gas injection engine, wherein the compressed gas can be fed to the return line if the quantity exceeds the fuel requirement of the high-pressure gas injection engine.

The advantage of such a device as part of a fuel gas supply system is that the highly compressed gas can either be reliquefied at pressure $p_{high}$ or used to drive a high-pressure gas injection engine. The adjustability of the quantity that is fed to the gas injection engine or into the PRS allows the climatic and meteorological conditions as well as the fuel requirements of the high-pressure gas injection engine (e.g. driving speed) to be flexibly taken into account.

In one embodiment, the device further comprises

- a second expansion unit which is set up to expand compressed gas from a pressure $p_{expand}$ to a pressure $p_{knock\text{-}out\text{-}drum}$ (typically 1-3 bar above the tank pressure),
- a gas-liquid separator which is fluidly connected downstream to the second expansion unit and is set up to feed a liquefied gas portion back into the LNG tank at a pressure $p_{knock\text{-}out\text{-}drum}$ and to feed a gaseous portion into the withdrawal line;

wherein the second expansion unit and the gas-liquid separator are arranged between the line of the heat exchanger for the passage of compressed gas to be cooled and the LNG tank in a fluid-conducting manner.

Due to the renewed expansion in the second expansion unit (e.g. expansion valve, expander), the gas is cooled again by Joule-Thomsen expansion. The gaseous component separated by the gas-liquid separator can then be combined with the BOG removed from the storage tank and fed to the heat exchanger as a coolant. The liquid component is fed into the storage tank. Thanks to the arrangement described, a higher relative proportion of the BOG can be reliquefied, preferably with the same amount of available coolant.

It is preferred that the first cooler is a water cooler, preferably water from the ship's cooling water system is used as a coolant, so that the compressed gas can be cooled to a temperature of 35 to 45° C. Water is plentiful, especially when the device is used on a ship. Cooling to the therewith achievable temperature of 35 to 45° C. when starting with gas at a particularly high pressure results in a lower enthalpy already after the first cooling step compared to processes using lower pressures.

In a preferred embodiment, the multi-stage compressor arrangement has a first compression stage, wherein the first compression stage is arranged to compress BOG (F2) from the LNG tank to a first pressure p1 between 6 and 18 bar, and wherein the first compression stage has at least one labyrinth-sealed piston compressor.

If the first compression stage has at least one labyrinth-sealed piston compressor, and preferably exclusively comprises labyrinth-sealed piston compressors, the first compression stage can be operated with little or no lubricant. On the one hand, this has the advantage that the quality of the compressed gas is not impaired by contamination with lubricant. On the other hand, the risk of the lubricant (typically oil) solidifying at the low temperatures of the BOG in low compression stages and promoting wear of the machine parts can be avoided.

In a preferred embodiment, the multi-stage compressor arrangement of the device has a middle and a last compression stage, which are set up to compress pre-compressed gas from a first pressure p1 to the pressure $p_{high}$, preferably optionally to the pressure $p_{high}$ of the pressure $p_{low}$, wherein the last compression stage has a bypass with a controllable valve in order to control the return flow and thus the delivery pressure after the last compression stage, wherein gas can be fed back via the bypass in such a way that the gas at the outlet has the predetermined target pressure value $p_{high}$, preferably the predetermined target pressure value pressure $p_{high}$ or $p_{low}$.

Such a device has the previously mentioned advantages that the efficiency of reliquefaction can be improved for high gas delivery rates and the size of the device elements can be reduced. If the multi-stage compressor arrangement can now be operated variably thanks to the bypass with controllable valve, or if gas with a variable pressure between $p_{low}$ and $p_{high}$ can be provided at the outlet as a result, further advantages arise. The multi-stage compressor arrangement can be set up in such a way that the side stream for reliquefaction at low reliquefaction rates is only compressed to $p_{low}$, which is more efficient for low reliquefaction rates. In addition, the service life of the devices can be improved if they are operated at only 50% of the nominal pressure for a considerable part of the operating time.

It is particularly preferable if the bypass with controllable valve can be regulated in such a way that any set pressure between 100 and 300 bar can be set. This allows the user additional flexibility to take account of the climatic and meteorological conditions and the fuel requirements of the engine(s).

In one embodiment, the last compression stage comprises at least one piston compressor sealed with a piston ring, preferably two piston compressors sealed with a piston ring. Piston compressors, preferably lubricated ones, that are sealed with a piston ring enable the gas to be compressed to a pressure in the range of $p_{high}$.

The device as described above may further comprise a branch line which is arranged downstream of the first compression stage in a fluid-conducting manner and which opens further downstream into a supply line for a low-pressure gas injection engine and/or a gas combustion unit.

This allows an engine that is operated at low pressure ($p_1$), such as an X-DF engine, to be supplied with fuel that is removed after the first compression stage. In this embodiment, it is particularly advantageous if the first compression stage is sealed with little or no lubricant, as this allows a high-quality fuel to be supplied to the low pressure gas injection engine and/or the gas combustion unit.

The invention relates to the use of the device as described above on a ship, for example a natural gas tanker, in particular a ship which is propelled by a high-pressure gas injection engine. When used on a ship, the above-mentioned advantages, in particular the reduced size of the device, are particularly evident due to the limited space available.

The invention is further explained by means of figures. The figures are for illustrative purposes and are not to be understood as limiting.

Figure 2:
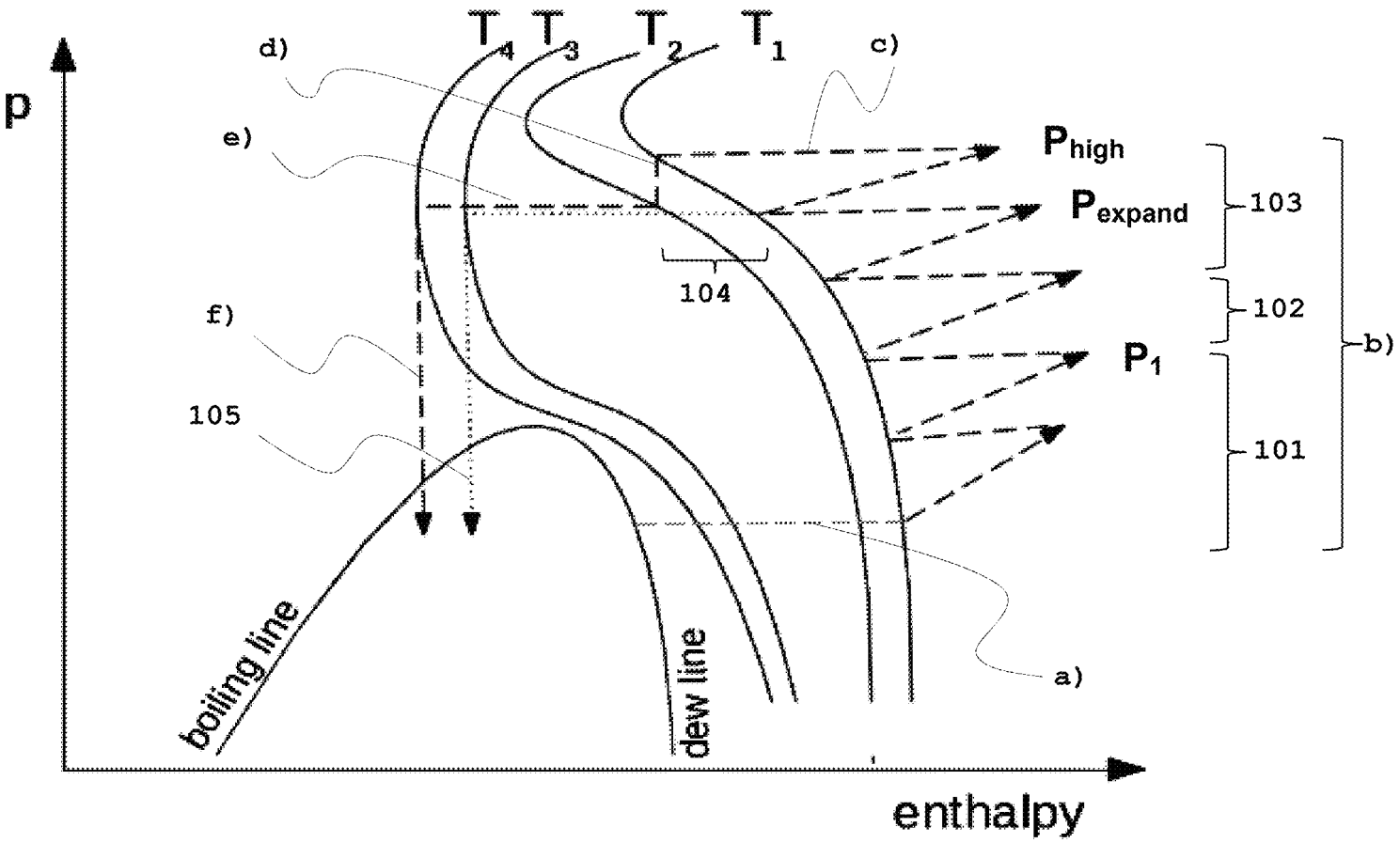

It shows:

FIG. 1 a schematic representation of a device according to the present invention;

FIG. 2 a schematic Mollier diagram illustrating a method according to the present invention.

FIG. 1 schematically shows a fuel gas supply system according to the present invention with a device for reliquefying and returning boil-off gas (BOG) to a liquefied natural gas (LNG) tank 3. The BOG (F2) accumulating in the head space of LNG tank 3 is fed via extraction line 5 to a heat exchanger 20 to be used as a cooling fluid in indirect heat exchange and then compressed by a multi-stage compressor arrangement 10 to a high pressure $p_{high}$ of typically approx. 300 bar.

In the embodiment shown, the multi-stage compressor arrangement 10 comprises a first compression stage with piston compressors 71 and 72 and associated coolers, a middle compression stage with piston compressor 73 and associated cooler, and a final compression stage with piston compressors 74 and 75 and associated coolers. The first compression stage 71, 72 is set up to compress the BOG to a pressure p1 of typically 7 bar. Part of the BOG compressed in this way, preferably without lubricant, can be fed to the low-pressure gas injection engine 4 via branch line 6, if required. The first compression stage can be pressure-controlled by means of a bypass with a pressure control valve (not shown).

The multi-stage compressor arrangement 10 is fluidly connected downstream to a first water cooler 50, wherein the compressed gas is cooled to typically 40° C. The outlet pressure of the highest compression stage, here consisting of piston compressors 75 and 74 and associated water coolers, is regulated via a bypass 19 with pressure control valve 9. After leaving the first water cooler 50, the compressed BOG can either be fed to a high-pressure gas injection engine 2 as fuel via the outlet 7 or fed to a first expansion unit 60, for example an expansion valve or an expander, via the return line 8. Typically, excess BOG that exceeds the fuel requirement of the engine 2 is fed to the return line 8. The gas is expanded in the first expansion unit 60 to a pressure $p_{expand}$ of approx. 150 bar. Due to the isenthalpic pressure reduction, the compressed natural gas undergoes renewed cooling and can therefore be further cooled from approx. 20° C. in indirect heat exchange with the BOG (F2) from the LNG tank 3 in the heat exchanger 20.

The BOG compressed by the compressor arrangement and cooled by water cooling 50, expansion 60 and heat exchange 20 is expanded again in a second expansion unit 30, now to a pressure $p_{knock\text{-}out\text{-}drum}$ of typically 1 bar, and finally separated into a liquid component and a gaseous component by a gas/liquid separator 40. The liquid component separated by the gas/liquid separator 40 is fed back into the LNG tank, and the gaseous component separated by the gas/liquid separator is combined in the withdrawal line 5 with the BOG emerging from the LNG tank and then fed to the heat exchanger 20 to be used as a cooling fluid.

In the BOG reliquefaction system as shown in FIG. 1, reliquefaction of natural gas is carried out using BOG taken from the storage tank as a refrigerant without the need for a separate cycle to reliquefy BOG. It will be understood that the present invention is not limited thereto, and a separate refrigeration cycle may be established to ensure reliquefaction of all BOG, if required. Such a separate circuit can ensure the reliquefaction of the BOG, but separate equipment or an additional energy source is required.

FIG. 2 shows the compression and cooling cycle in the schematic Mollier diagram with dashed lines. In its initial state, the BOG is located to the right of the dew line at an atmospheric pressure of 1 bar and approx. −160° C. When removed from the LNG tank a), especially when used as a coolant in indirect heat exchange, the BOG heats up to ambient temperature or higher, approx. T1.

In step b), compression to $p_{high}$ takes place, for example in accordance with the compressor arrangement shown in FIG. 1 using five piston compressors. These can be arranged as first compression stage 101, middle compression stage 102 and last compression stage 103, each with subsequent water cooling to the temperature $T_1$. Overall, the natural gas can thus be compressed to a pressure of typically 300 bar. After the final cooling to $T_1$ by water cooling in step c), at least part of the gas is isenthalpically expanded in step d) to a pressure $p_{expand}$ of typically 150 bar. Due to the Joule-Thomson effect, the temperature of the gas is reduced to $T_2$, typically to approx. 20° C. In step e), the gas is cooled further to a temperature $T_4$ of approx. −75° C. In the device shown in FIG. 1, this takes place in indirect heat exchange 20 with cooling BOG from the headspace of the LNG tank. Step f) is the return of the gas to the LNG tank, which typically involves further isenthalpic expansion and the separation of liquid and gaseous parts in the gas/liquid separator.

FIG. 2 shows the advantage of compressing the gas to the pressure $p_{high}$ with subsequent cooling c) and expansion d): Compared to compression to just $p_{expand}$ followed by water cooling, an enthalpy difference 104 can be obtained in the form of a lower temperature $T_2$ of the gas. If compression is only to $p_{expand}$, the gas is at a higher temperature $T_1$ at the same pressure $p_{expand}$ and the cooling capacity of the coolant available in the heat exchanger must be used to cool warmer gas (dotted line). As the coolant is not available indefinitely in the case of BOG, the less compressed gas in the heat exchanger can often only be cooled to the temperature $T_3$ instead of $T_4$, and the subsequently expanded gas is only reliquefied to a lesser extent, corresponding to arrow 105.

Not shown in FIG. 2 is operating mode ii) as described above, in which the BOG is compressed to a pressure $p_{low}$ and expanded to $p_{expand}$ *in the* case of $p_{low}>p_{expand}$. This operating mode requires that the middle and last compression stages are set up to compress pre-compressed gas from a first pressure $p_1$ optionally to a pressure $p_{high}$ of, for example, 300 bar, or to a pressure $p_{low}$ of, for example, 150 bar. The pressure can, for example, be regulated by a bypass with a controllable valve, which is arranged in the last compression stage 103. If the controllable valve can be regulated in such a way that any target pressure between $p_{low}$ and $p_{high}$ can be set, further pressures in the return line 8 of FIG. 1 or in the diagram of FIG. 2 parallel below the dotted line c) are conceivable.

The invention claimed is:

1. A method for reliquefying and returning boil-off gas (BOG) to a liquefied natural gas (LNG) tank, comprising the steps:

a) removal of BOG from a headspace of an LNG tank;

b) compressing the BOG to a pressure $p_{high}$, c) cooling the compressed gas to a temperature $T_1$;

d) isenthalpically expanding at least part of the gas from step c) to a pressure $p_{expand}$, e) cooling the gas expanded in step d), by means of a heat exchanger in counterflow with cooling BOG from the headspace of the LNG tank, to a temperature $T_4$;

f) returning the gas from step e) to the LNG tank;

wherein the pressure $p_{high}$ is at least 200 bar, and wherein the pressure $p_{expand}$ is 80 to 180 bar.

2. The method according to claim 1, wherein in step d) at least a first portion of the gas from step c) is supplied to a high-pressure gas injection engine via an outlet to an extent of a fuel requirement of the high-pressure gas injection engine, and at least a second portion of the gas from step c) is expanded isenthalpically to the pressure $p_{expand}$.

3. The method according to claim 1, wherein step b) is preceded by step 0), and step 0) is a selection between an operating mode i) compressing the BOG to a pressure $p_{high}$ comprising steps b) to d); and an operating mode ii) compressing the BOG to a pressure $p_{low}$, comprising the steps of b1) compressing the BOG to a pressure $p_{low}$ of 100 to 199 bar; and d1) isenthalpic expansion of at least part of the gas from step c) to a pressure $p_{expand}$, if $p_{low}>p_{expand}$;

wherein, in the case of operating mode ii), steps b1) and d1) replace steps b) and d).

4. The method according to claim 3, wherein in step 0) in operating mode i) a setpoint value $p_{high}$ in a range from 200 to 300 bar is selected, or in operating mode ii) a setpoint value $p_{low}$ in a range from 100 to 199 bar is selected.

5. A device for reliquefying and returning boil-off gas (BOG) into a liquefied natural gas (LNG) tank, comprising:

a heat exchanger, comprising a line for a passage of cooling fluid, wherein the cooling fluid is BOG from an LNG Tank, and a line for a passage of compressed gas to be cooled;

a multi-stage compressor arrangement which is set up to compress BOG from the LNG tank to a pressure $p_{high}$, a first cooler;

a return line; and a first expansion unit, which is set up to isenthalpically expand compressed gas from a pressure $p_{high}$ to a pressure $p_{expand}$;

wherein the multi-stage compressor arrangement is fluidly connected upstream, via the line of the heat exchanger for passing through cooling fluid, to a withdrawal line opening into a head space of the LNG tank, and wherein the multi-stage compressor arrangement is fluidly connected downstream to the first cooler, further downstream via the return line to the first expansion unit, and still further downstream to the line of the heat exchanger for passing through compressed gas to be cooled, in order to return the compressed and cooled gas to the LNG tank;

wherein the pressure $p_{high}$ is at least 200 bar, and wherein the pressure $p_{expand}$ is 80 to 180 bar.

6. The device according to claim 5, wherein the device is part of a fuel gas supply system for supplying a high-pressure gas injection engine with gas stored in an LNG tank, additionally comprising an outlet which is arranged downstream of the multi-stage compressor arrangement in a fluid-conducting manner and opens further downstream into a supply line for a high-pressure gas injection engine, wherein the compressed gas, insofar as its quantity exceeds a fuel requirement of the high-pressure gas injection engine, can be fed to the return line.

7. The device according to claim 5, further comprising a second expansion unit, which is set up to expand compressed gas from a pressure $p_{expand}$ to a pressure $p_{knock\text{-}out\text{-}drum}$, a gas-liquid separator which is fluidly connected downstream of the second expansion unit and is set up to feed a liquefied gas portion back into the LNG tank at a pressure $p_{knock\text{-}out\text{-}drum}$ and to feed a gaseous portion into the withdrawal line;

wherein the second expansion unit and the gas-liquid separator are arranged in a fluid-conducting manner between the line of the heat exchanger for the passage of compressed gas to be cooled and the LNG tank.

8. The device according to claim 5, wherein the first cooler is a water cooler.

9. The device according to claim 5, wherein the multi-stage compressor arrangement comprises a first compression stage, wherein the first compression stage is arranged to compress BOG from the LNG tank to a first pressure p1 between 6 and 18 bar, and wherein the first compression stage comprises at least one labyrinth-sealed piston compressor.

10. The device according to claim 5, wherein the multi-stage compressor arrangement comprises a middle and a last compression stage, which are arranged to compress pre-compressed gas from a first pressure p1 to the pressure $p_{high}$, wherein the last compression stage has a bypass with a controllable valve in order to control the return flow and thus the delivery pressure after the last compression stage, wherein gas can be fed back via the bypass in such a way that the gas at the outlet has the predetermined target pressure value $p_{high}$.

11. The device according to claim 10, wherein the bypass with controllable valve be regulated in such a way that any setpoint pressure between 100 and 300 bar can be set.

12. The device according to claim 10, wherein the last compression stage comprises at least one piston compressor sealed with a piston ring.

13. The device according to claim 9, further comprising:

a branch line which is arranged downstream of the first compression stage in a fluid-conducting manner, and which opens further downstream into a supply line for a low-pressure gas injection engine and/or a gas combustion unit.

14. A method of use of a device according to claim 5 on a vessel, comprising the steps of providing said device on the vessel, and reliquefying and returning boil-off gas (BOG) to a liquefied natural gas (LNG) tank, wherein reliquefying and returning comprises the steps:

a) removal of BOG from a headspace of the LNG tank;

b) compressing the BOG to a pressure $p_{high}$, wherein the pressure $p_{high}$ is at least 200 bar;

c) cooling the compressed gas to a temperature $T_1$;

d) expanding at least part of the gas from step c) to a pressure $p_{expand}$, wherein wherein the pressure $p_{expand}$ is 80 to 180 bar;

e) cooling the gas expanded in step d) to a temperature $T_4$;

f) returning the gas from step e) to the LNG tank.

* * * * *